US007055334B2

(12) United States Patent
Tanaka et al.

(10) Patent No.: US 7,055,334 B2
(45) Date of Patent: Jun. 6, 2006

(54) AIR-CONDITIONING UNIT AND AIR-CONDITIONING APPARATUS INCORPORATING SAME

(75) Inventors: Daisuke Tanaka, Nagoya (JP); Katsuhiro Hashitsume, Nagoya (JP); Seiji Ando, Nagoya (JP); Yuji Nakajima, Yokohama (JP); Susumu Kojima, Nagoya (JP); Kenichi Miyazawa, Nishi-kasugai-gun (JP); Hiroshi Kanbara, Nishi-kasugai-gun (JP); Takayuki Suzuki, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/801,555

(22) Filed: Mar. 17, 2004

(65) Prior Publication Data

US 2004/0182093 A1 Sep. 23, 2004

(30) Foreign Application Priority Data

Mar. 18, 2003 (JP) ..... 2003-073662

(51) Int. Cl.
*F24F 3/16* (2006.01)

(52) U.S. Cl. ..... 62/78; 62/90; 62/92; 62/93

(58) Field of Classification Search ..... 62/78, 62/90–93, 186, 187, 309, 314; 55/481, 486, 55/495

See application file for complete search history.

(56) References Cited

U.S. PATENT DOCUMENTS 5,004,487 A * 4/1991 Kowalczyk ..... 96/127
5,015,451 A * 5/1991 Holter et al. ..... 423/235
5,467,606 A 11/1995 Sasaki et al.
5,646,597 A * 7/1997 Hamburger et al. ..... 340/627
5,731,157 A * 3/1998 Miller et al. ..... 435/7.4
5,806,238 A * 9/1998 Brenner et al. ..... 43/139
6,077,517 A * 6/2000 Thomas et al. ..... 424/275.1
6,087,947 A * 7/2000 Hamburger et al. ..... 340/627
6,126,707 A * 10/2000 Pitzen ..... 55/495
6,289,974 B1 * 9/2001 DeGregoria et al. ..... 165/8
6,372,004 B1 * 4/2002 Schultink et al. ..... 55/382
6,579,352 B1 6/2003 Tanaka et al.
6,797,042 B1 * 9/2004 LaFerriere et al. ..... 95/273

FOREIGN PATENT DOCUMENTS

EP 0958851 A1 11/1999
JP 62-228826 A * 10/1997
JP 10-296036 * 10/1998
JP 2000-15024 * 1/2000

(Continued)

*Primary Examiner*—Mohammad M. Ali

(74) *Attorney, Agent, or Firm*—Wenderoth, Lind & Ponack, L.L.P.

(57) ABSTRACT

An indoor air-conditioning unit 10 which can effectively deactivate allergens includes an intake grill 11 for drawing in indoor air. Indoor heat exchangers 13, 14, and 15 exchange heat between air drawn in from the intake grill 11 and a refrigerant to thereby cool or heat the air. A diffuser 16 returns the air which has been heat-exchanged with the indoor heat exchangers 13, 14, 15, back into the room. A cross-flow fan 17 blows air which has been drawn in from the inlet and heat exchanged from the diffuser 16 into the room. An allergen deactivation filter 18 is arranged in an internal space 5 through which the air flows and supports an allergen deactivation enzyme. An enzyme activation device maintains the internal space S in an atmosphere for activating the allergen deactivation enzyme.

5 Claims, 11 Drawing Sheets

FOREIGN PATENT DOCUMENTS

| | | | |
|---|---|---|---|
| JP | 2000015036 A | * | 1/2000 |
| JP | 2000-167326 | * | 6/2000 |
| JP | 2001-27589 | * | 1/2001 |
| JP | 2003-33612 | | 2/2003 |
| JP | 2003-180865 | | 7/2003 |
| JP | 2003-210919 | | 7/2003 |
| KR | 10-0182529 B1 | * | 12/1998 |

* cited by examiner

AIR-CONDITIONING UNIT AND AIR-CONDITIONING APPARATUS INCORPORATING SAME

BACKGROUND OF THE INVENTION

1. Field of the Invention

The present invention relates to an air-conditioning unit and an air-conditioning apparatus, and in particular relates to technology suitable for use in the deactivation of allergens, which are causative agents for allergic symptoms.

2. Description of the Related Art

Recently the existence of causative agents causing abnormal reactions (allergies) in the human body has become known. These causative agents are generally referred to as allergens.

When an allergen somehow enters the human body, the immune system of the human body aggressively reacts with the allergens and causes allergic symptoms such as asthma, atopic dermatitis, rhinitis and conjunctivitis. As such allergens, there are known various pollens, mites and fungi.

The majority of the above allergens are drifting in the air. Therefore, most of the known allergic symptoms are believed to be due to inhalation of this air. In an indoor environment prone to cause such allergic symptoms, it is speculated that the allergic symptoms can be alleviated by removing or reducing such allergens from the air.

Therefore, in conventional air-conditioning apparatus used for indoor air-conditioning (cooler, heater and dehumidification), to deal with alergens, it has been proposed to provide an allergen deactivation device such as a ventilation device for actively ventilating the interior, a filter, and a catalyst, and to continuously monitor the amount of allergen by an allergen sensor. Guidelines have been established to realize an operation for actively passing an allergen atmosphere through the allergen deactivation device to deactivate the allergen (refer to Japanese Unexamined Patent Application, First Publication No. 2002-181371).

As mentioned above, air-conditioning is often performed in an indoor environment which is prone to cause allergic symptoms due to drifting alergens. Therefore it is desirable to deactivate the allergens by effective utilization of an air-conditioning apparatus. The present inventors have acquired knowledge concerning enzymes which deactivate allergens, that is, related to the presence of atmospheric conditions ideal for activating allergen deactivation enzymes. Activating allergen deactivation enzymes implies stimulating the action of the enzymes to breakdown the protein structure of the allergens. As a result, by breaking down (deactivating) the allergens, the appearance of allergic symptoms can be prevented or inhibited.

From the above background, it is desirable to arrange allergen deactivation enzymes within an air-conditioning unit of the air-conditioning apparatus, and appropriately form a high temperature and humidity atmosphere which activates the allergen deactivation enzymes, so that allergens are effectively deactivated using the air-conditioning apparatus. In this case, it is desirable to minimize the addition of new components to the air-conditioning apparatus, and effectively utilize the essential constituents and functions conventionally provided, to thereby keep down rising costs.

BRIEF SUMMARY OF THE INVENTION

The present invention takes into consideration the above situation, with an object of providing an air-conditioning unit and an air conditioning apparatus which can effectively deactivate allergens.

To achieve the above objectives, the present invention employs the following means.

An air-conditioning unit of the present invention comprises: an inlet for drawing in air; a heat exchanger for exchanging heat between air drawn in from the inlet and a refrigerant; a diffuser for discharging air which has been heat-exchanged by the heat exchanger; an airflow device for blowing air from the diffuser; an enzyme carrier arranged in an internal space through which the air flows, and which supports an allergen deactivation enzyme; and an enzyme activation device which creates an atmosphere for activating the supported allergen deactivation enzyme.

According to this air-conditioning unit, since it comprises the enzyme carrier arranged in the internal space through which the air flows, and which supports the allergen deactivation enzyme, and the enzyme activation device which creates (produces or forms) an atmosphere for activating the allergen deactivation enzyme in the internal space, then in the enzyme carrier supporting the allergen deactivation enzyme, when the atmosphere for activating the allergen deactivation enzyme is created by the enzyme activation device, allergens collected in the enzyme carrier can be deactivated by the activated enzyme.

Moreover, the air-conditioning unit of the present invention has an internal air retaining device which retains air flow within the internal space.

By retaining air flow within the internal space by the internal air retaining device, creation of the atmosphere for activating the allergen activation enzyme by means of the enzyme activation device is promoted.

In particular, as the internal air retaining device there is preferably provided an open/close device which closes a part or all of openings communicating with the internal space, to keep the internal space in a semi-enclosed or fully enclosed condition. As a result, creation of the atmosphere for activating the allergen deactivation enzyme by means of the enzyme activation device is facilitated.

As the internal air retaining device, instead of the open/close device, there may be provided an airflow device stop device which stops the airflow device. Moreover, when considering an application to a vehicle air conditioner, there may be provided an airflow path switching damper which can partition a space by switching thereof.

Furthermore, preferably the internal space is kept in the enclosed condition, and the airflow device is operated to agitate the air which constitutes an atmosphere for activating the allergen deactivation enzyme in the enclosed internal space. As a result, the atmosphere of the internal space can be made uniform.

Moreover, in the air-conditioning unit of the present invention, preferably the enzyme activation device heats and evaporates condensed water generated by the cooling operation of the heat exchanger by means of a heating operation of the heat exchanger, which is performed after the cooling operation. As a result, the enzyme activation device can be constructed by the components of a normal air-conditioning apparatus, and a warm humid atmosphere for activating the allergen deactivation enzyme can be formed.

Furthermore, in the air-conditioning unit of the present invention, preferably the enzyme activation device heats and evaporates the condensed water generated by the cooling operation of the heat exchanger, and stored on a drain pan, by means of a heating device. As a result, the enzyme activation device can be constructed by adding the heating device to the components of a normal air-conditioning apparatus, and a warm humid atmosphere for activating the allergen deactivation enzyme can be formed.

Moreover in the air-conditioning unit of the present invention, preferably after the internal space has bean maintained at a high temperature and high humidity by the enzyme activation device, a degradation-prevention operation is performed to remove moisture from the enzyme carrier. As a result, by creating an atmosphere which does not activate the allergen deactivation enzyme, degradation can be suppressed, and the life of the enzyme can be extended.

Furthermore in the air-conditioning unit of the present intention, preferably prior to performing allergen deactivation by means of the enzyme carrier, an allergen collection operation is performed which draws in air to the internal space and passes this through the enzyme carrier. As a result, the allergens can be collected on the enzyme carrier and effectively deactivated. As the allergen collection operation, a normal cooler, heater, or dehumidifying operation may be performed, or simply the airflow device alone may be operated, to perform an airflow operation which circulates the air.

Moreover the air-conditioning apparatus of the present invention comprises the aforementioned air-conditioning unit, a compressor for compressing a refrigerant, an external heat exchanger for performing heat exchange between the refrigerant compressed by the compressor and air, and refrigerant piping for connecting between the air-conditioning unit, the compressor, and the external heat exchanger, and circulating refrigerant between the air-conditioning unit, the compressor, and the external heat exchanger.

According to this air-conditioning apparatus, since the air-conditioning unit is provided with the enzyme carrier arranged in the internal space through which the air flows, and which supports the allergen deactivation enzyme, and the enzyme activation device which creates in the internal space an atmosphere for activating the allergen deactivation enzyme, then in the enzyme carrier supporting the allergen deactivation enzyme, when the atmosphere for activating the allergen deactivation enzyme is created by the enzyme activation device, allergens collected in the enzyme carrier can be deactivated by the activated enzyme.

According to the air-conditioning unit of the present invention, and the air-conditioning apparatus incorporating this, the following effects are demonstrated.

According to the air-conditioning unit of the present invention, since it comprises the enzyme carrier arranged in the internal space through which the air flows, and which supports the allergen deactivation enzyme, and the enzyme activation device which creates in the internal space an atmosphere for activating the allergen deactivation enzyme, then in the enzyme carrier supporting the allergen deactivation enzyme, when the atmosphere for activating the allergen deactivation enzyme is created by the enzyme activation device, the allergens collected in the enzyme carrier can be efficiently broken down and deactivated by the activated enzyme. Therefore, the allergen concentration in the air can be reduced, and a favorable environment in which allergen symptoms are unlikely to occur can be readily provided.

Furthermore in the abovementioned air-conditioning unit, by providing an open/close device which closes a part or all of the openings communicating with the internal space, to keep the internal space in a semi-enclosed or fully enclosed condition, it is difficult for the high temperature and humidity atmosphere of the internal space to leak out to the outside. Hence maintaining the atmosphere for activating the allergen deactivation enzyme by means of the enzyme activation device is facilitated, so that efficient allergen inactivation becomes possible. In particular, if the internal space is in a fully enclosed condition, maintaining the atmosphere is further facilitated.

Moreover, in the abovementioned air-conditioning unit, since the internal space is kept in the fully enclosed condition, and the airflow device is operated to agitate the air which constitutes an atmosphere for activating the allergen deactivation enzyme in the enclosed internal space, the atmosphere of the internal space can be made uniform, and the entire area of the enzyme support bodies can be effectively used so that the allergens can be efficiently deactivated.

Furthermore, in the abovementioned air-conditioning unit, since the enzyme activation device is one which heats and evaporates the condensed water generated by the cooling operation of the heat exchanger, by means of a heating operation of the heat exchanger which is performed after the cooling operation, the function of the enzyme activation device can be obtained by the components of a normal air-conditioning apparatus, and a warm humid atmosphere for activating the allergen deactivation enzyme can be formed at low cost.

Moreover, in the abovementioned air-conditioning unit, since the enzyme activation device is one which heats and evaporates the condensed water generated by the cooling operation of the heat exchanger, and stored on a drain pan, by means of a heating device, the enzyme activation device can be constructed by adding the heating device to the components of a normal air-conditioning apparatus, and a warm humid atmosphere for activating the allergen deactivation enzyme can be formed at relatively low cost.

Then after the internal space has been maintained at a high temperature and high humidity by the enzyme activation device, by performing a degradation-prevention operation to remove moisture from the enzyme carrier, degradation can be suppressed by creating an atmosphere which does not activate the allergen deactivation enzyme, and the life of the enzyme can be extended Therefore, the replacement cycle of the enzyme carrier can be extended, maintenance can be facilitated, and running costs can also be reduced.

Moreover, prior to performing allergen deactivation by means of the enzyme carrier, by performing an allergen collection operation which draws in air to the internal apace and passes this through the enzyme carrier, the allergens in the air can be collected on the enzyme carrier, and after collection most of the allergens can be effectively deactivated by a single operation.

According to the aforementioned air-conditioning apparatus, since the air-conditioning unit is provided with the enzyme carrier arranged in the internal space through which the air flows, and which supports the allergen deactivation enzyme, and the enzyme activation device which creates in the internal space an atmosphere for activating the allergen deactivation enzyme, then in the enzyme carrier supporting the allergen deactivation enzyme, when the atmosphere for activating the allergen deactivation enzyme is created by the enzyme activation device, allergens collected in the enzyme carrier can be efficiently broken down and deactivated by the activated enzyme. Therefore, this provides an air-conditioning apparatus which can reduce the allergen concentration in the air, and readily provides a favorable environment in which allergen symptoms are unlikely to occur.

BRIEF DESCRIPTION OF THE SEVERAL VIEWS OF THE DRAWINGS

FIG. 9A is a graph showing the trend of changes of allergen deactivation atmosphere (temperature/ humidity) against heating time (Th), while

DETAILED DESCRIPTION OF THE INVENTION

Hereunder is a description of embodiments of an indoor air-conditioning unit (air-conditioning unit) and an air-conditioning apparatus according to the present invention, with reference to the drawings.

Figure 1:
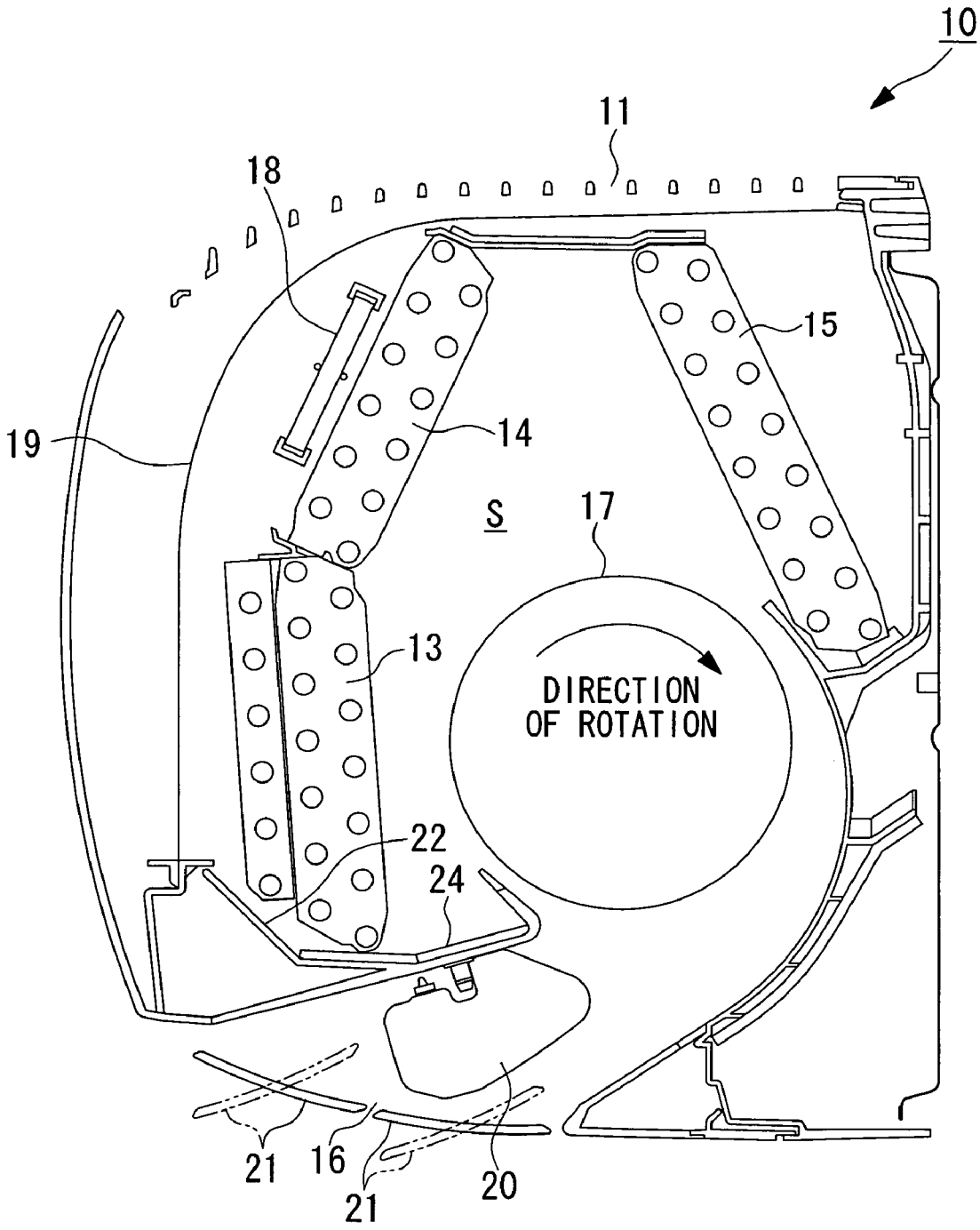
FIG. 1 is a sectional view showing a first embodiment of an indoor air-conditioning unit according to the present invention.
Figure 2:
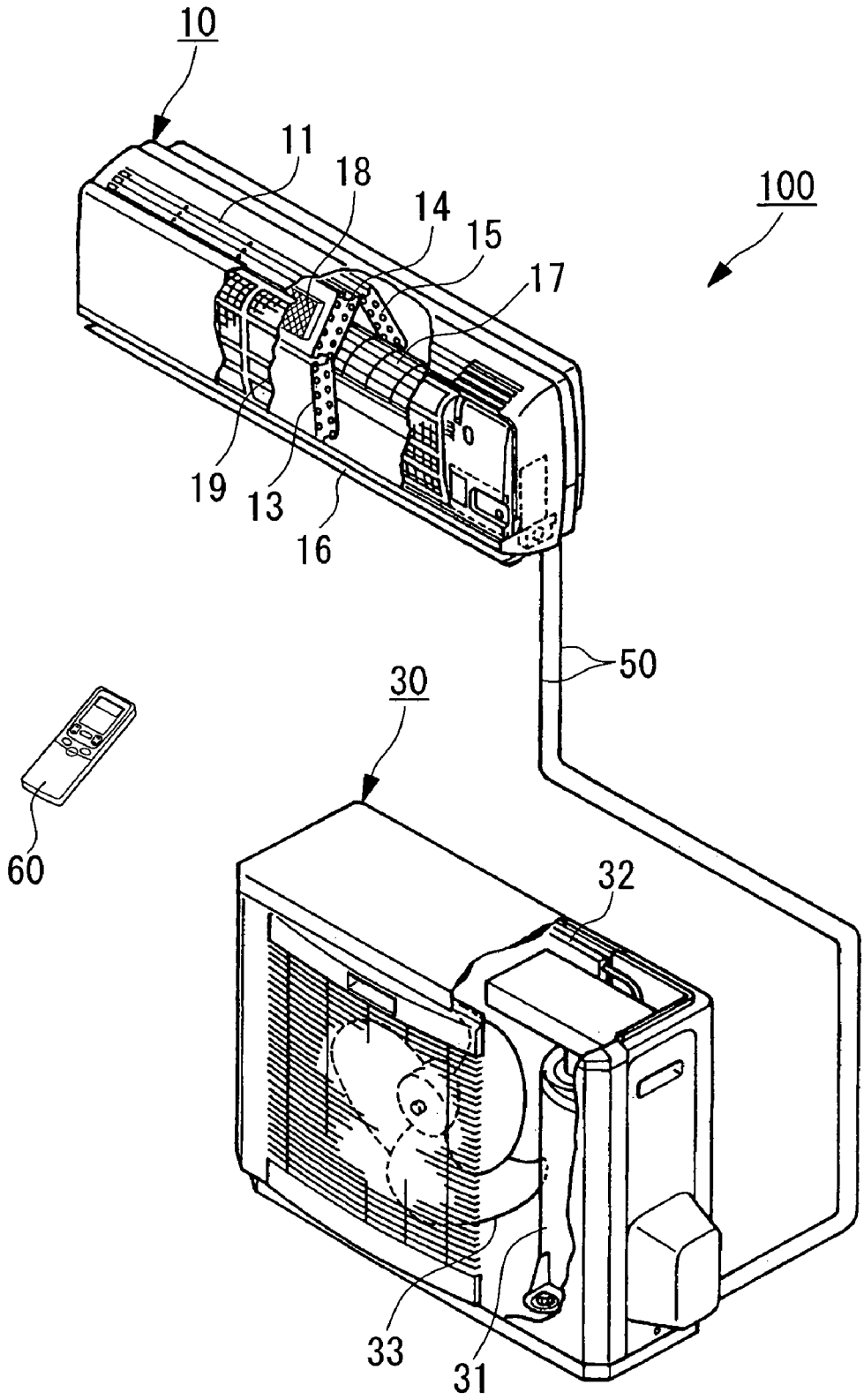
FIG. 2 is a perspective view showing the general structure of an air-conditioning apparatus according to the present invention.

FIG. 1 is a sectional view of an indoor air-conditioning unit 10, while FIG. 2 is a perspective view showing an air-conditioning apparatus 100 comprising the indoor air-conditioning unit 10 and an outdoor air-conditioning unit 30.

As shown in FIG. 1 and FIG. 2, the indoor air-conditioning unit 10 comprises, as its main components, an intake grill (inlet) 11 for drawing in indoor air, indoor heat exchangers 13, 14 and 15 for cooling or heating the indoor air drawn in from the intake grill 11, a diffuser 16 for returning the air which has been heat-exchanged by the indoor heat exchangers 13, 14 and 15 back into the room, a cross-flow fan (air flow device) 17 for drawing in air from the intake grill 11 and blowing the heat-exchanged air from the diffuser 16 into the room, and an allergen deactivation filter (enzyme support) 18 arranged at a position above and near the upstream side of the air flow path of the heat exchanger 14.

A pre-filter 19, which is arranged to extend from the interior front face of the indoor air-conditioning unit 10 to the interior upper face, is provided for removing impurities such as dust and dirt from the air which passes through the intake grill 11 and enters the indoor heat exchangers 13, 14 and 15.

In the abovementioned indoor air-conditioning unit 10, the intake grill 11, the indoor heat exchangers 13, 14 and 15, the diffuser 16, the cross-flow fan 17 and the pre-filter 19 are conventionally known components, and hence their description is omitted here.

Moreover, the diffuser 16 is also provided with conventional outlet louvers 20 and discharge flaps 21 for adjusting the discharge direction. Opening and closing of the diffuser is possible by operation of the discharge flaps 21.

FIG. 2 is a schematic diagram of the air-conditioning apparatus 100 incorporating the abovementioned indoor air-conditioning unit 10.

In FIG. 2, reference symbol 30 denotes the outdoor air-conditioning unit. The outdoor air-conditioning unit 30 has a compressor 31 for compressing refrigerant, an outdoor heat exchanger (external heat exchanger) 32 for heat exchange between the refrigerant and the outdoor air, and an outdoor fan 33 to facilitate heat exchange between the refrigerant in the outdoor heat exchanger 32 and the outdoor air. As described later based on FIG. 3, a four way valve 34 and an electronic expansion valve 35 are also arranged in the outdoor air-conditioning unit 30.

Moreover, reference symbol 50 in FIG. 2 denotes refrigerant piping for connecting between the indoor air-conditioning unit 10 and the outdoor air-conditioning unit 30 and circulating the refrigerant between the indoor air-conditioning unit 10 and the outdoor air-conditioning unit 30.

Reference symbol 60 in FIG. 2 denotes a remote controller. By means of this, operating conditions of the air-conditioning apparatus 100 can be set.

Several configurations of the allergen deactivation filter 18 are available, as illustrated in FIG. 4A to FIG. 5C. The allergen deactivation filter 18 is also described in detail in the patent literature 1, previously filed by the present applicant.

Figure 4A:
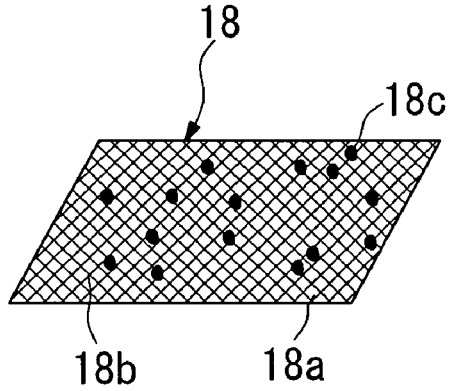
FIGS. 4A and 4B show a first configuration example of an allergen deactivation filter, FIG. 4A being a general view and FIG. 4B being a partial enlarged view.
Figure 4B:
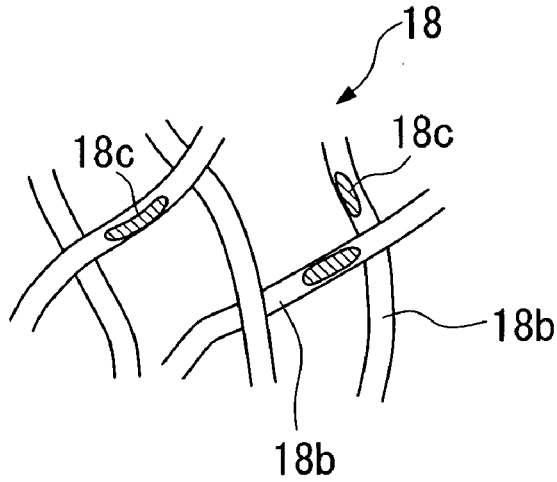

FIGS. 4A and 4B show a first configuration example, FIG. 4A being a general view and FIG. 4B being a partially enlarged view of FIG. 4A.

The allergen deactivation filter 18 comprises a filter body 18*a* and allergen deactivation enzymes (hereunder simply called enzymes) 18*c* directly supported on fibers 18*b* constituting the filter body 18*a*. Here the fibers 18*b* include for example fibers of glass, rayon, cellulose, polypropylene, polyethylene terephthalate, polyacrylic acids, or polyacrylamides.

Here supporting the enzyme 18*c* on the fiber 10*b* is not limited to a physical support configuration, and may also use a chemical support configuration. For instance, the enzyme can be supported on the substrate by first acidifying the carboxyl group of the substrate and then chemically bonding it with the enzyme by amide interchange. As well as the carboxyl group, functional groups such as a hydroxyl group or an amino group can also be used for chemical bonding. Methods for chemically supporting in this manner are well know from the past (New Experimental Chemistry Seminar in Biochemistry (I), pp. 363 to 409, Maruzen (1978)).

According to the allergen deactivation filter 18 of this configuration example, the construction is such that the enzymes 18*c* having the function for deactivating the allergens are supported on the filter body 18*a*. Therefore, the amount of allergens that are activated can be considerably reduced.

Figure 5:
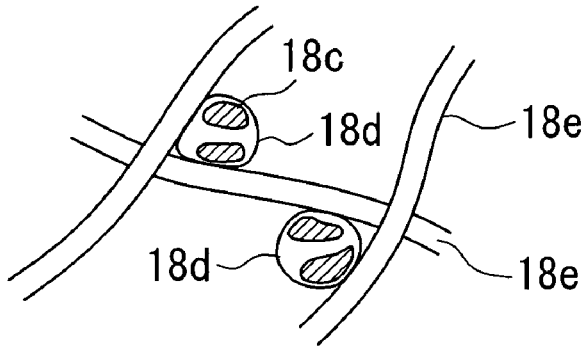
FIG. 5 shows a second configuration example of an allergen deactivation filter showing the main parts of the allergen deactivation filter.

FIG. 5 illustrates a second configuration example of the allergen deactivation filter 18, showing the main parts of the allergen deactivation filter. This configuration example is characterized in that, as shown in FIG. 5, the enzymes 18*c* are supported on a support body 18*d* having absorbency and/or hygroscopicity, and the support body 18*d* is in turn secured to fibers 18*e* using a binder (not shown).

Here, examples of the material of the support body 18*d* include for example synthesized materials such as polyacrylic acids, polyacrylamides or polyvinyl alcohols, or naturally-found materials such as cotton, wool, sodium alginate, mannan, agar and the like, or regenerated materials such as rayon. Furthermore, examples of the material of the filter fibers 18*e* include polyethylene (PE), polypropylene (PP), polyethylene terephthalate (PET), and polyamide (PA).

According to the allergen deactivation filter 18 of this configuration example, the construction is such that the enzymes 18*c* are supported on the filter body 18*a* having absorbency and/or hygroscopicity, and the support body 18*d* is in turn secured to the fibers 18*e* using a binder (not shown). Therefore, this has a similar effect to that of the first configuration example.

Figure 6A:
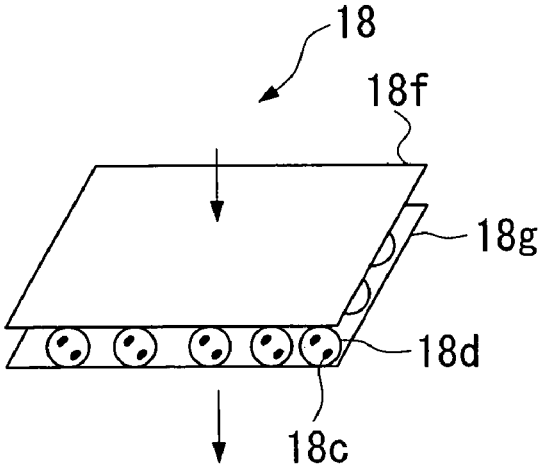
FIGS. 6A and 6B show other configuration examples of the allergen deactivation filter, FIG. 6A being a general view showing a third configuration example of the allergen deactivation filter, and FIG. 6B being a general view showing a fourth configuration example of the allergen deactivation filter.

FIG. 6A shown a third configuration example of the allergen deactivation filter 18. Here, the allergen deactivation filter 18 comprises a plurality of support bodies 18*d* supporting enzymes 18*c* and substrates 18*f* and 18*g* that sandwich the support bodies 18*d* from the top and bottom.

Here, examples of the material of the support bodies 18*d* include, for example, polyacrylic acids, polyacrylamides, polyvinyl alcohols, cotton, wool, rayon, sodium alginate, mannan and agar. The aforementioned substrates 18*f* and 18*g* are made of unwoven fabric of the fibers 18*e*. Here, for the substrate 18*g* located beneath the support bodies led, making this an unwoven fabric having a mesh smaller than the diameter of pollens (diameter: 20 to 30 μm) or mites (particularly their excrement, diameter: 10 to 40 μm), is desirable from the sense of preserving the support bodies 18*d*.

According to the flat allergen deactivation filter 18 of this configuration example, the construction is such that the support bodies 18*d* supporting the enzymes 18*c* are sandwiched between the two substrates 18*f* and 18*g* from the top and bottom. Therefore, this has a similar effect to that of the abovementioned configuration example.

Figure 6B:
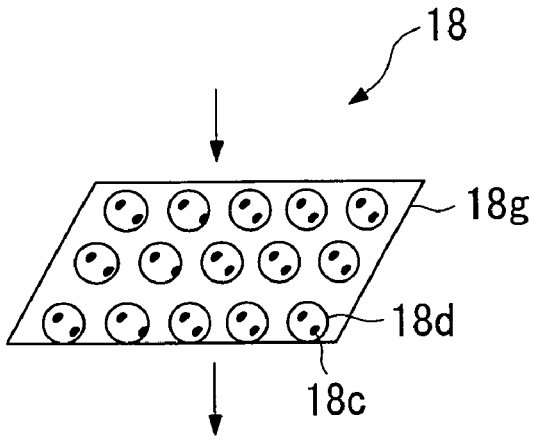

Furthermore, FIG. 6B shows a fourth configuration example of the allergen deactivation filter 18. Even with the open sandwich type flat allergen deactivation filter, as shown in FIG. 6B, the same effect as for the abovementioned configuration examples can be demonstrated.

Figure 7:
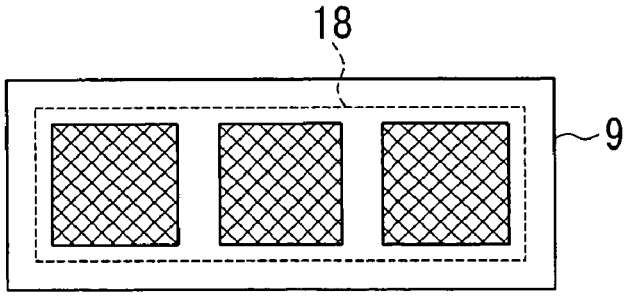
FIG. 7 is the plan view showing the allergen deactivation filters shown in FIG. 4A through FIG. 6B fitted into a cartridge.

The allergen deactivation filters 18 in any of the first through fourth configurations mentioned so far are used by fitting into a cartridge 9 as shown in FIG. 7, which is arranged for example in the air flow path of the indoor air-conditioning unit 10.

Figure 8A:
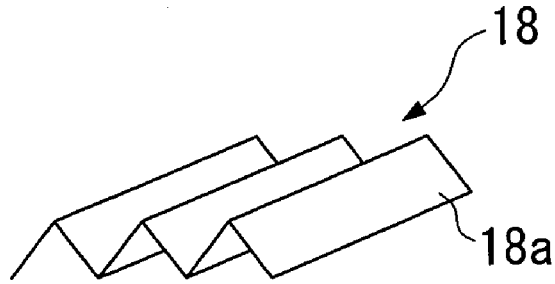
FIGS. 8A to 8C show yet other configuration example of the allergen deactivation filter, FIG. 8A being a general view showing a fifth configuration example of the allergen deactivation filter, FIG. 8B being a general view showing a sixth configuration example of the allergen deactivation filter, and FIG. 8C being a general view showing a seventh configuration example of the allergen deactivation filter.

FIG. 8A shows a fifth configuration example of the allergen deactivation filter 18. This allergen deactivation filter 18 is constructed by constructing the filter body 18*a* from fibers which directly support the enzymes, and then folding this filter body 18*a* into pleats.

According to the pleat type allergen deactivation filter 18 of this configuration example, the construction involves constructing the filter body 18*a* from fibers which directly support the enzymes, and then folding this filter body 18*a* into pleats. Therefore, compared to the aforementioned configuration examples, this has a lower pressure drop. Also, due to the increased opportunity for contact with the allergens, collection efficiency can be increased, and evaporation of moisture can be suppressed.

Figure 8B:
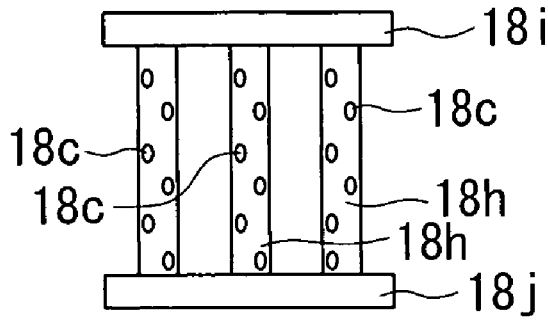
Figure 8C:
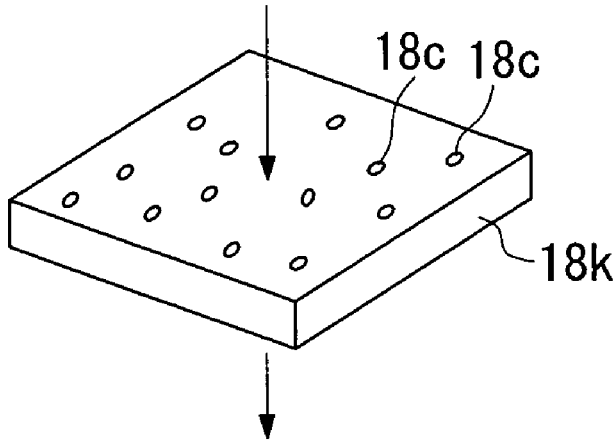

FIG. 8B shows a sixth configuration example of the allergen deactivation filter 18. In this allergen deactivation filter 18, the construction is such that the fibers on which the enzymes 18*c* are supported are bundled together into rod-like members 18*h* with circular cross-sections, and opposite ends of these rod-like members 18*h* are connected to support members 18*i* and 18*j*.

According to the rod-like type allergen deactivation filter 18 of this configuration example, the construction involves constructing the rod-like members 18*h* from fibers which support the enzymes, and then connecting opposite ends of these rod-like members 18*h* to the support members 18*i* and 18*j*. Therefore, compared to the aforementioned first to fourth configuration examples, this has a lower pressure drop. Also, since the amount of supported allergens is increased, the deactivation ability can be increased and the life extended.

In the sixth configuration example, the cross-section of the rod-like members is a circle. However it is not particularly limited to this, and for example may be a triangular, rectangular, oval, or tubular shape. Furthermore, there is no particular limitation on the direction of the rod-like members, and these may be arranged all in the same direction horizontally, laterally, or diagonally, or these may be criss-crossed. Moreover, in the case when the allergen deactivation filter 18 of this configuration example is installed in an indoor air-conditioning unit 10, this can be advantageously applied when installed at a location where the flow of air is fast, such as at the diffuser 16, or at both the intake grill 11 and the diffuser 16.

FIG. 5C shows a seventh configuration example of the allergen deactivation filter 18. In this allergen deactivation filter 18, the construction is such that the enzymes 18*c* are supported on the surfaces of a porous material 18*k* such as urethane.

According to the sponge type allergen deactivation filter 18 of this configuration example, this has a similar effect to that of the aforementioned first to fourth configuration examples.

The abovementioned allergen deactivation enzyme is one which can modify or breakdown the proteins that constitute the allergen. While there are no particular limitations, examples include protease and peptidase.

Protease is an enzyme which hydrolyzes the peptide bonds of protein molecules to thereby transform proteins into peptones moreover, peptidase has an action of hydrolyzing the peptide bonds at amino terminal ends or carboxyl terminal ends of peptide chains. Furthermore, for the applicable enzymes, acidic, basic or neutral enzymes can be used, in an amount up to 1 million U (unit quantity of enzymes to breakdown 1 μmol of protein in one minute). However, there is no problem if there are more than this.

As the material of the abovementioned filter body, water absorbing and/or hygroscopic materials being natural or regenerated materials, for example naturally-found fibers such as cotton and wool, regenerated fibers such as rayon or cellulose acetate, unwoven fabric or knitted fabric of synthetic fibers such as polyethylene, polyethylene terephthalate, or polyamide, glass fiber mat, metal fiber mat, synthesized resins such as acrylic acids, acrylamides, and polyvinyl alcohols, or sodium alginate, mannan, agar etc., can be used. The enzymes are secured to the abovementioned filter body either directly or via a support body.

The latest research of the present applicants has revealed that the abovementioned allergen deactivation enzymes are active at a normal temperature and humidity, but become more active in a warm and humid atmosphere.

To specifically illustrate the warm and humid atmosphere in which the allergen deactivation enzymes are activated, this is preferably a temperature over 20° C. and humidity over 50% RT. A more preferable temperature is 35° C. to 50° C., and a more preferable humidity is 70% RT to 90% RT.

Now, the abovementioned indoor air-conditioning unit 10 with the allergen deactivation filter 18 is provided with an enzyme activation device which creates (produces or form), in an internal space S, a high temperature and humidity allergen enzyme activation atmosphere. Here, the internal space S is the airflow path (space) from where the air is drawn in from the intake grill 11 until it is discharged from the diffuser 16.

In a first embodiment of this enzyme activation device, except for the allergen deactivation filter 18, just the constituents with which the air-conditioning apparatus 100 is normally provided are effectively utilized, and operated, without newly adding special components.

That is to say, there is provided an allergen deactivation operating mode for making the refrigerant circuit comprising for example the existing heat exchanger in the air-conditioning apparatus 100 function as an enzyme activation device. A control device of the air-conditioning apparatus 100 executes this operating mode to thereby maintain the internal space S interior of the indoor air-conditioning unit 10 at a warm and humid atmosphere to activate the allergen deactivation enzyme, and due to the operation of the activated allergen deactivation enzyme, allergens which have been collected in the allergen deactivation filter 18 are broken down and irreversibly deactivated, thereby realizing an allergen deactivation process.

In this allergen-deactivation operation mode, moisture is necessary to generate the warm and humid atmosphere. Therefore the cooling operation of the indoor heat exchangers 13, 14 and 15 provided inside the indoor air-conditioning unit 10 is executed continuously for a predetermined time (TCP), and the condensed water generated on the surface of the same heat exchangers is utilized as moisture to achieve the required humidity. In this cooling operation of the indoor heat exchangers 13, 14 and 15, the refrigerant can be circulated by the same path as during the cooler operation and the dehumidifying operation when the same heat exchangers are used as evaporators. Hereunder, this cooling operation is referred to as a "condensed water generating operation".

Figure 3:
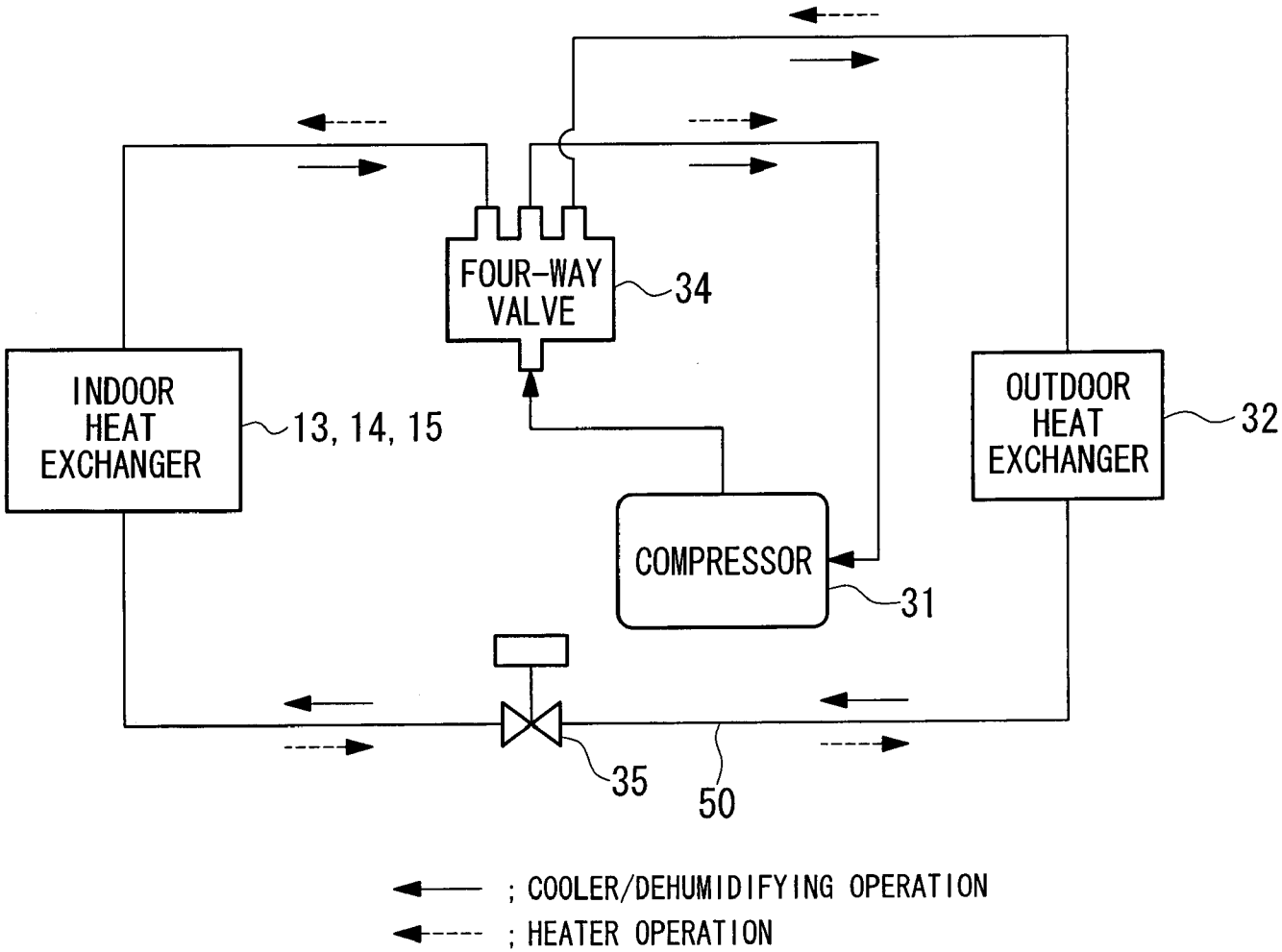
FIG. 3 is the refrigerant circuit diagram for the air-conditioning apparatus shown in FIG. 2.

In this condensed water generating operation, as shown in the refrigerant circuit diagram of FIG. 3, the compressor 31 and the outdoor fan 33 on the outdoor air-conditioning unit 30 side are operated to circulate the refrigerant, while on the indoor air-conditioning unit 10 side, the discharge flap 21 provided in the diffuser 16 is opened and the cross-flow fan 17 is operated.

At this times regarding the refrigerant circulation path as shown by the solid line arrows in FIG. 3, after the refrigerant is discharged from the compressor 31 the circulation direction is selectively switched by the four-way valve 34, and the refrigerant then flows in sequence clockwise to the outdoor heat exchanger 32, the electronic expansion valve 35, the indoor heat exchangers 13, 14 and 15, and the four-way valve 34, and then returns to the compressor 31. According to this flow of refrigerant, a refrigerant of a gas-liquid two-phase fluid is supplied to the indoor heat exchangers 13, 14 and 15, and heat is exchanged with the air. Therefore, the air which is deprived of its heat of vaporization is cooled, and the moisture in the air condenses due to the temperature drop and attaches to the surface of the heat exchangers. The condensed water produced in this manner drips from the surfaces of the indoor heat exchangers 13, 14 and 15 into a drain pan 22, and is then drained from the indoor air-conditioning unit 10 through a predetermined drain path (not shown in the figure) to the outside.

After the abovementioned condensed water generating operation, the operation shifts to the heating operation where the generated condensed water is heated and evaporated to thus achieve a high temperature and humidity within the space S.

In this heating operation as shown by the broken line arrows in FIG. 3, the refrigerant discharged from the compressor 31 is switched by the four-way valve 34 so as to give a counterclockwise circulation flow opposite to that during the condensed water generating operation. That is to say, the refrigerant discharged from the compressor 31 flows out from the four way valve 34 and flows in sequence to the indoor heat exchangers 13, 14 and 15, the electronic expansion valve 35, the outdoor heat exchanger 32 and the four-way valve 34, and then returns to the compressor 31.

In this manner, also in the heating operation, if the refrigerant is circulated in the same manner as when operating as a heater, the high temperature and pressure gaseous refrigerant supplied to the indoor heat exchangers 13, 14, and 15, exchanges heat with the air and condenses. As a result, the indoor heat exchangers demonstrate a heat releasing function as condensers, and by using this released heat as a heating means, the condensed water attached to the surfaces of the indoor heat exchangers can be evaporated.

To facilitate the evaporation of the condensed water during the heating operation, different from when operating as a heater, although the compressor 31 and the outdoor fan 33 of the outdoor air-conditioning unit 30 are operated, the operation of the cross-flow fan 17 is halted and the discharge flaps 21 are operated to close the diffuser 16. As a result, the internal space S of the indoor air-conditioning unit 10 becomes a semi-enclosed condition with the diffuser 16 shut, so that the temperature of the internal space S interior is raised by the heat released from the indoor heat exchangers 13, 14, and 15, and the water vapor from the condensed water which receives the released heat (heating) from the indoor heat exchangers 13, 14, and 15 and is evaporated, accumulates in internal space S interior and raises the humidity. Therefore, the high temperature and humidity enzyme activation atmosphere (allergen deactivation atmosphere) can be readily formed.

Here, because the water vapor of the evaporated condensed water passes through a flow path rising approximately straight up, then so that the allergen deactivation filter 18 can reliably absorb the moisture, the allergen deactivation filter 18 should be arranged above the indoor heat exchangers 13, 14, and 15, and more desirably to simplify formation of the water vapor path, directly above the indoor heat exchangers.

Regarding the installation of the allergen deactivation filter 18, this may be arranged at least along the air flow path for normal cooler operations and heater operations, and at a place where it can come in contact with the water vapor inside the indoor unit formed by the heating operation. However, the position of the allergen deactivation filter is not necessarily limited to above the indoor heat exchangers.

As the internal space S is filled with the enzyme activation atmosphere, the enzymes 18*c* supported on the allergen deactivation filter 18 become active. Therefore allergens collected in the filter 18 are deactivated by the operation of the enzymes 18*c*.

The duration of the heating operation for deactivating the allergens in this way can be appropriately determined in accordance with a target allergen deactivation rate. Here the allergen deactivation rate (R) as shown in FIG. 9B, after elapse of a heating operation time (Th) for forming the desired allergen deactivation atmosphere, increases approximately proportionately with the heating time (Th). The allergen deactivation rate (R) represents the proportion of deactivated allergens to the total allergens as a percentage %.

Accordingly, once an allergen deactivation rate (r) is determined, the heating operation time (Th2) corresponding to this is obtained.

Figure 10:
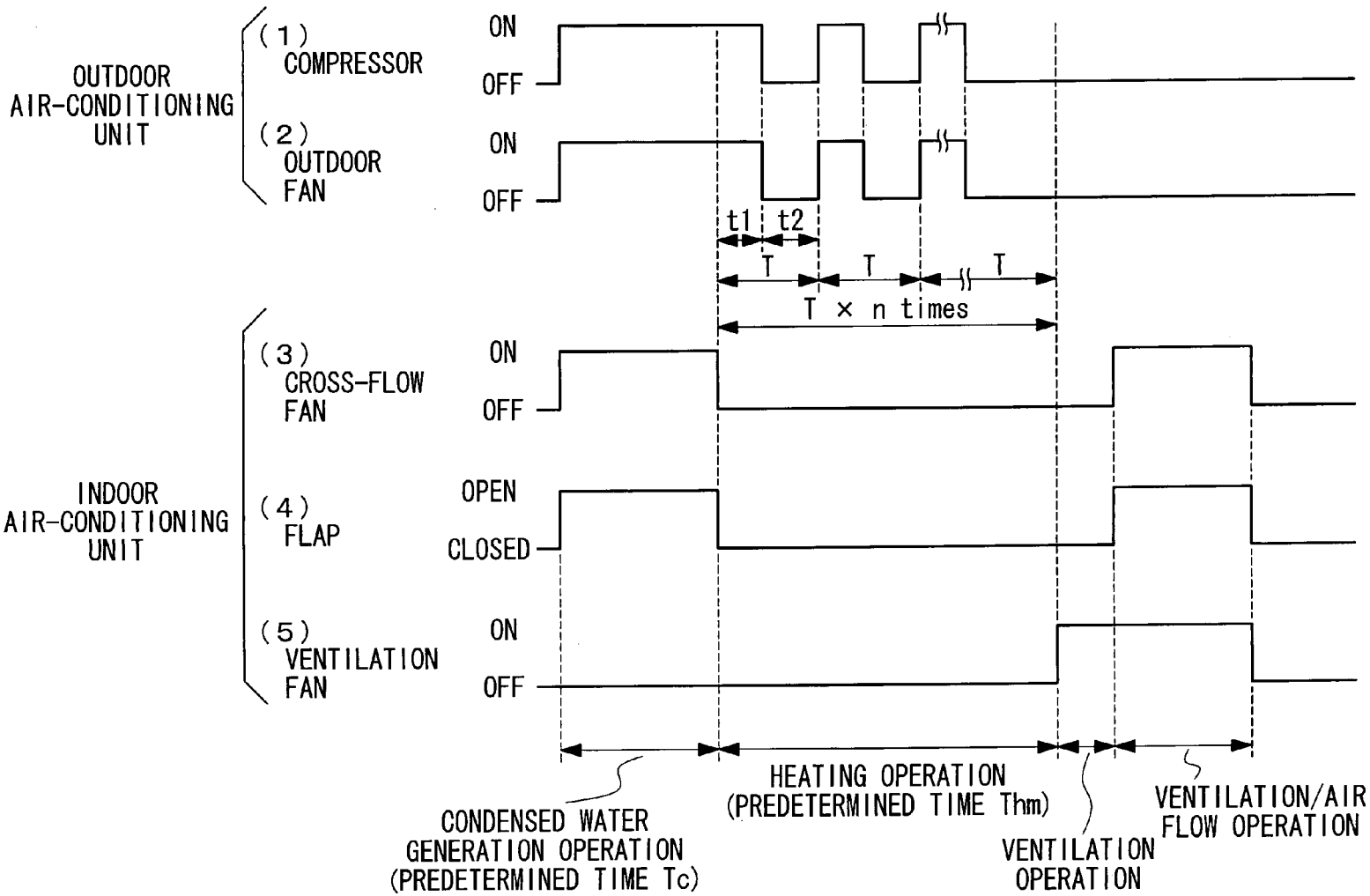
FIG. 10 is an explanatory diagram showing specific operating conditions of each item during execution of the condensed water generating operation and the heating operation.

To ensure this heating time (Th2), then as shown in FIG. 10, in the heating operation, it is preferable to intermittently operate the compressor 31 and the outdoor fan 33. This intermittent operation is set as shown in the example of FIG. 10 so as to have n repetitions with the heating operation time in one cycle as T (fixed).

That is to say, during the heating operation time (T) in one cycle, if the operation time for the compressor 31 and the outdoor fan 33 is t1, and the stopped time is t2, then the heating operation time (T) in one cycle is always T=t1+t2. In other words, an intermittent operation is executed with both times t1 and t2 appropriately adjusted so that if t1 increases, t2 is decreased.

As a result, the total operating time for the heating operation becomes (T×n), and T and n can be set so that T×n≧Th2.

In the adjustment of the times t1 and t2, for example when the indoor temperature and humidity is high, the operating time t1 for heating is set shorter. On the other hand, when the indoor temperature and humidity is low, the operating time t1 for heating is set longer.

With this intermittent drive, it is possible to prevent equipment such as the heat exchanger from becoming a temperature exceeding the operating limit, as well as preventing the whole quantity of condensed water obtained in the condensed water generating operation from evaporating and disappearing in a short period of time. That is to say, in the case where intermittent operation is not executed, the temperature and humidity increase approximately linearly as shown by the trend of respective changes in FIG. 9A, with the single-dot chain line (humidity) and the two-dot chain line (temperature), and the heating continues on even after the set value (P) is exceeded at the point where the heating time is (Tha). Therefore there is the possibility of temperatures and humidities far in excess of the set value (P), and hence timing control becomes more difficult.

Moreover, additional heating after this high temperature will result in the condensed water completely evaporating in a short while. After all the condensed water has evaporated, the humidity sharply drops whilst the temperature continues to rise. Consequently, the humidity at the point after lapse of the heating operation time (Thb) falls below the set value (P) for the target allergen deactivation atmosphere. Therefore, this causes a phenomena where a predetermined heating operation time (Thm) cannot be ensured.

Here, the heating operation time (Thm) can be set to be greater than the difference of the heating operation times obtained from FIG. 9B, that is (Thm≧Th2−Th1).

On the other hand, when intermittent operation is executed, intermittent heating results, so that in practice the temperature and humidity fluctuate within a certain range. Consequently if the operating time (t1) is adjusted so that the lower limit in the fluctuation margin does not fall below the set value (P) of the target allergen deactivation atmosphere, it is possible to maintain the allergen deactivation atmosphere at a level higher than the target value, and continue this for longer than the necessary times. In other words, a heating operation to effectively use the limited condensed water amount to maintain the desired allergen deactivation atmosphere can be continued for the necessary time.

Figure 9A:
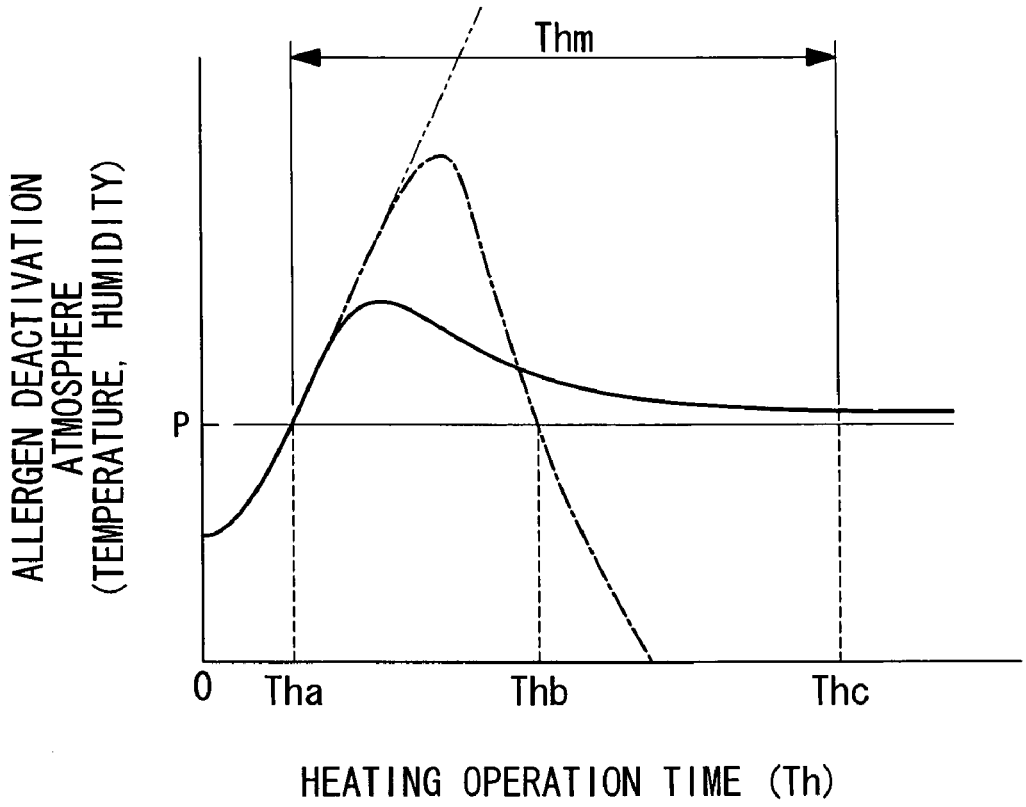
Figure 9B:
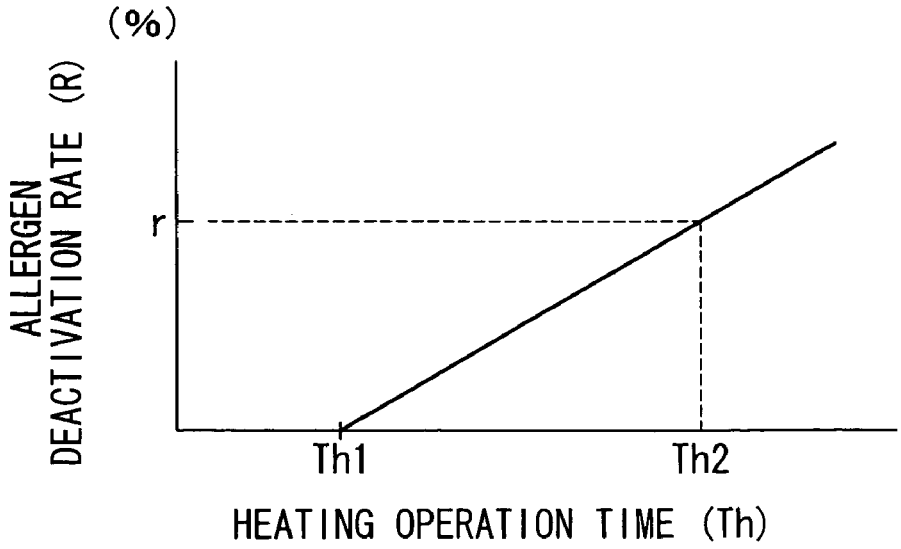
FIG. 9B is a graph showing a relationship between rate of allergen deactivation (R) and heating time (Th).

The solid line in FIG. 9A indicates the trend of changes in the allergen deactivation atmosphere at the time of intermittent operation. Wave-like fluctuations due to the interrupted operation are omitted from the figure.

In the above manner, by performing the condensed water generating operation and the heating operation, the internal space 8 of the indoor air-conditioning unit 10 can be maintained for the necessary time in the allergen deactivation atmosphere. Therefore, the enzymes 18*c* supported on the allergen deactivation filter 18 in this allergen deactivation atmosphere can be activated, and the collected allergens can be effectively deactivated.

Figure 11:
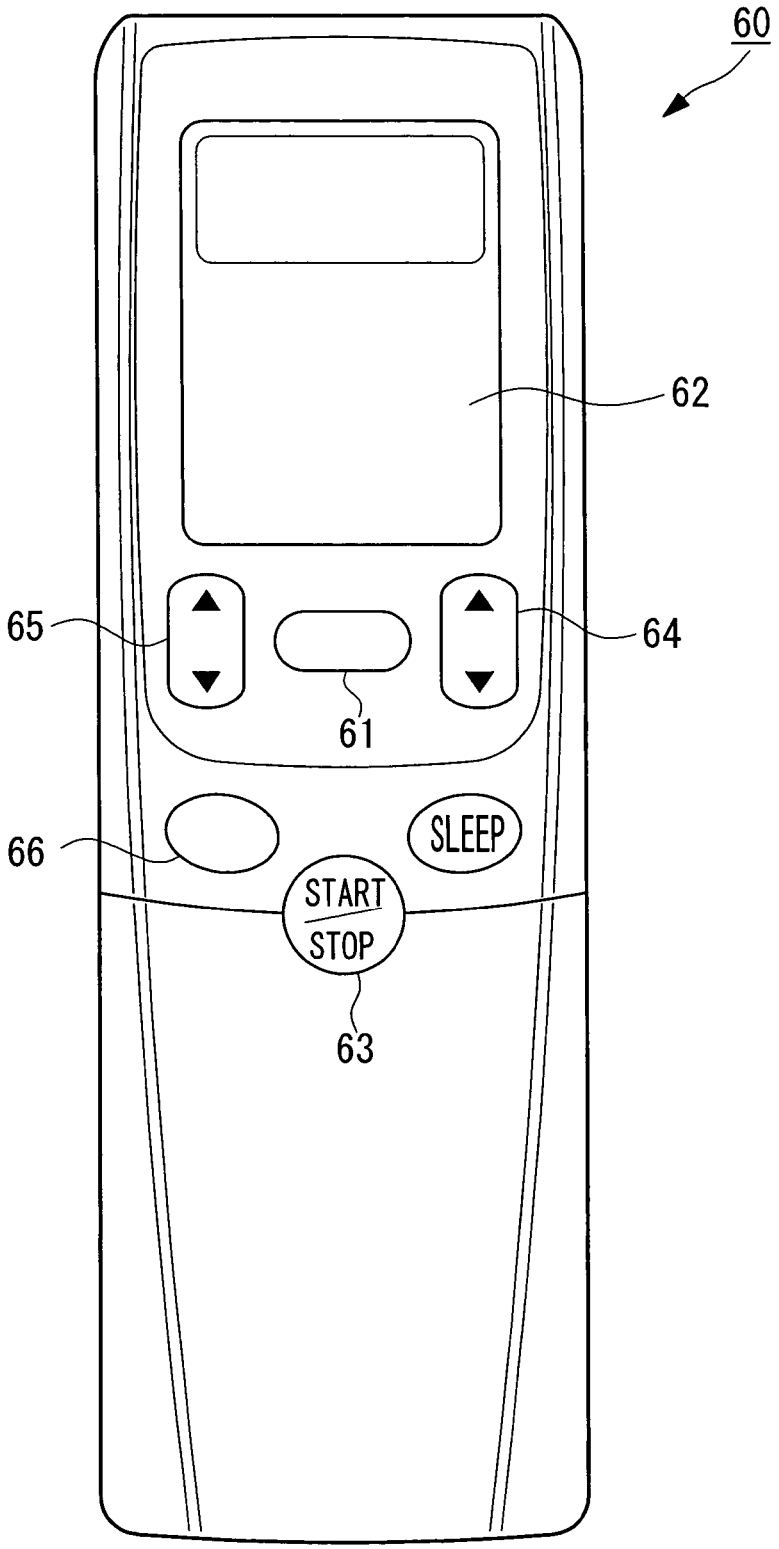
FIG. 11 is a plan view showing a specific example of a remote controller.

Moreover, the aforementioned allergen deactivation operation mode can be performed by a one touch operation of a predetermined switch provided at a suitable place such as on an operation panel. This switch operation can be realized for example, by pressing an allergen clear button 61 provided beforehand on a remote controller 60, as shown in FIG. 11.

In other words, pressing the allergen clear button 61 will generate a specified control signal for executing the allergen deactivation operation mode. When the allergen clear button 61 of the remote controller 60 is pressed, a control signal such as an infrared ray is transmitted to a receiving part of the indoor air-conditioning unit 10.

Apart from the above described allergen clear button 61, the remote controller 60 is also provided with a display panel 62, a start/stop button 63, a temperature control switch 64, a humidity control switch 65, an operation switching button 66, and so on.

The control signal is sent from the receiving part to a controller (not shown) of the air-conditioning apparatus 100. The controller which receives this signal then executes the abovementioned condensed water generating operation and the heating operation based on predetermined control steps to deactivate the allergen. In executing this allergen deactivation operation mode, when the allergen clear button 61 is pressed and the generated control signal is input to the control unit, this is executed with precedence over other operating modes. That is to say, in the case where the allergen clear button 61 is pressed during execution of the cooler or heater operation, the cooler or heater operation is stopped, and operation is switched to the allergen deactivation operation mode.

Furthermore, the abovementioned allergen deactivation operation mode can be suitably interrupted whenever necessary. The control signal to interrupt the allergen deactivation operation mode may be generated by pressing the allergen clear button 61 again, or by providing a dedicated stop button on the remote controller 60.

Since in the above manner, operation and stopping of the allergen deactivation operation mode can be selected by a switch operation of the remote controller 60, the operation for deactivating the allergen becomes possible with a simple operation.

This allergen deactivation operation mode may operate in conjunction with a timer function for the cooler/heater operation conventionally incorporated in the air-conditioning apparatus 100.

In this manner, in the allergen deactivation operation mode, a high temperature and humidity atmosphere is required. However, the time to reach the target changes depending on the indoor and outdoor environment (temperature and humidity). That is to say, the time for the condensed water generated by the condensed water generating operation to become a desired amount, or the time required for the condensed water to be evaporated and give a desired temperature and humidity, differs due to the aforementioned environment.

Therefore, at the time of executing the condensed water generating operation, it is desirable to control so as to provide operating conditions favorable for generating condensed water on the surface of the indoor heat exchangers 13, 14 and 15.

Hereunder are specific examples of operating conditions favorable for generating condensed water.

A first specific example is to operate with the opening of the electronic expansion valve 35 provided as a throttling mechanism, set to smaller than for at the time of normal cooler operation. As a result, the heat absorption of the refrigerant increases, and the surface temperature of the indoor heat exchangers 13, 14 and 15 drops further. Therefore the amount of condensed water forming on the surface of the indoor heat exchangers is increased. In this case, the opening of the electronic expansion valve 35 may be adjusted based on the detection value (room temperature) of an indoor temperature detection device provided in the indoor air-conditioning unit 10, with the opening of the electronic expansion valve 35 becoming smaller the higher the indoor temperature.

A second specific example is to execute low speed operation, with the rotation speed of the cross-flow fan 17 lower than for at the time of normal cooler operation, so that the air flow capacity is decreased, and the volume of air flowing through the indoor heat exchangers 13, 14 and 15 is reduced. Also when carrying out this operation, due to the decrease in the amount of heat absorption of the air, the surface temperature of the indoor heat exchangers 13, 14 and 15 becomes lower. Therefore the amount of condensed water forming on the surface of the indoor heat exchangers can be increased.

A third specific example is to detect the outdoor temperature, and adjust the rotation speed of the outdoor fan 33 provided in the indoor air-conditioning unit 30. In this case, if the rotation speed of the outdoor fan 33 is set to increase for higher outdoor temperatures, the amount of refrigerant condensed at the outdoor heat exchanger 32 is increased. Therefore, the amount of gas-liquid two-phase refrigerant supplied to the indoor heat exchangers 13, 14 and 15 is also increased. Consequently, the surface temperature of the indoor heat exchangers 13, 14 and 15 becomes lower. Therefore the amount of condensed water forming on the surface of the indoor heat exchangers can be increased.

The abovementioned first to third specific examples can be applied alone, or can be applied in combinations with each other, or can be applied all together.

However, these operating conditions are not necessarily limited to control which carries out the condensed water generation operation prior to the heating operation, and in the case where condensed water is generated by the normal cooler operation, the normal cooler operation may be positioned as the cooling operation, and control for executing the allergen deactivation operation mode wherein the heating operation is carried out after the cooler operation can then be performed.

Incidentally, in the allergen deactivation operation mode, by executing the aforementioned condensed water generating operation and the heating operation, the initial objective of activating the enzymes 18*c* to deactivate the allergen can be achieved.

However, by adding the operations described hereunder before and after the allergen deactivation operation mode, an improvement in operating efficiency of the allergen deactivation operation mode and an increase in life of the enzymes 18*c* can be realized.

First is a description of collection operation executed before the condensed water generating operation. This collection operation is an operation in which allergens in a room are collected in the allergen deactivation filter 18. This is an operation where the cross-flow fan 17 is operated to draw in indoor air from the intake grill 11, pass the air through the allergen deactivation filter 18 and then return the air back into the room by means of the diffuser 16. Since the purpose of the collection operation is to collect allergens onto the allergen deactivation filter 18, the room air need only pass through the allergen deactivation filter 18, and a simple air flow operation which merely circulates the room air will suffice. Furthermore, naturally with the normal cooler/dehumidifying operation or heater operation, the indoor air is similarly circulated via the allergen deactivation filter 18. Therefore the collection operation can be appropriately selected from the air circulation operation, the cooler/dehumidifier operation and the heater operation depending on the conditions inside the room and user preference.

When the indoor air is circulated in this manner and the air passes through the filter body 18*a*, the air can pass through the filter body 18*a*, but the majority of the allergens circulating with the air cannot pass through and are collected. Therefore if the collection operation is continued for an appropriate operation time, taking into consideration the room size, the expected allergen concentration and the collection performance of the allergen deactivation filter 18, most of the allergens in the room can be collected in the allergen deactivation filter 18.

When the allergen deactivation operation mode is executed in this condition with most of the allergens collected, then by a single allergen deactivation operation lost of the collected allergens can be deactivated. Therefore the indoor allergens can be effectively deactivated, enabling room circulation with low allergen concentration.

In addition, it is desirable to promptly clear the warm and humid conditions of the internal space S interior after completion of the allergen deactivation mode. Particularly when considering the long life of the enzyme 18*c*, this is to suppress hydrolysis occurring between the enzymes 10*c* and the residual moisture in the allergen deactivation filter 18, and the self-breakdown of the enzymes 18*c*. Preferably, an environment which can restore the degree of allergen activation back to the level for the normal atmosphere, i.e. a low temperature low humidity atmosphere, is desirable from the point of suppressing degradation of the enzymes over time.

Therefore, in the case of an indoor air-conditioning unit with an ordinary ventilation device (not shown) which discharges air in the room to the outside, as shown in FIG. 10, a suitable operating time is determined and the ventilation operation executed, after completion of the heating operation accompanying the duration of a predetermined active enzyme retention period which keeps the enzymes in an active condition. In this ventilation operation, the discharge flaps 21 are closed in order to prevent a decrease in air-conditioned feeling due to direct discharge of the warm humid atmosphere into the room. By keeping the internal space S semi-enclosed and operating the ventilation fan (not shown), it is possible to discharge the warm and humid atmosphere present in the internal space S to outside of the room.

After executing the ventilation operation for a predetermined time to discharge the warm and humid atmosphere to outside of the room, an air flow operation due to the cross-flow fan 17 in addition to the ventilation fan is also started. At this time, the discharge flaps 21 are closed so that the internal space S is kept semi-enclosed. By producing the flow of air within the internal space S by the ventilation and the air flow, the allergen deactivation filter 18 can be dehumidified and dried. For such a degradation prevention operation using both the ventilation and the air flow, an appropriate operation time can be set in accordance with the capacity of the internal space S.

When in this way the control device of the air-conditioning apparatus 100 executes the degradation prevention operation mode which implements the ventilation operation and the air-flow operation after completion of the allergen deactivation operation mode, the internal space S is promptly cleared of the warm and humid environment, so that the time in which the enzymes 18*c* are unnecessarily active can be shortened. Therefore degradation of the enzymes 18*c* can be suppressed by that amount, and their life thus extended. That is to say, the replacement life of the allergen deactivation filter 18 can be extended.

In the above description, it was assumed that the indoor air-conditioning unit incorporates a ventilation device. However in the case of an indoor air-conditioning unit with no ventilation device, the ventilation operation is not possible. Therefore after completion of the heating operation, the air flow operation may be performed on the internal space S in the semi-enclosed condition by the cross-flow fan 17, and the allergen deactivation filter 18 dried by the flow of air produced by this.

Moreover, in the abovementioned embodiment, a control is adopted which performs a degradation prevention operation for the allergen deactivation filter using both the air flow operation and the ventilation operation in the case where a ventilation device is provided, and which performs a degradation prevention operation using only the air flow operation in the case where a ventilation device is not provided. However even in the case where the ventilation device is provided, the mode for the degradation prevention operation can be selectively executed to remove the moisture from the enzyme carrier using the air flow operation alone or both the air flow operation and the ventilation operation according to the degree of high temperature and high humidity for enzyme activation.

Incidentally, regarding the indoor air-conditioning unit 10 described so far, since the intake grill 11 is always open, the internal space S is in a semi-enclosed condition at the time of the heating operation with the discharge flaps 21 closed.

Figure 12:
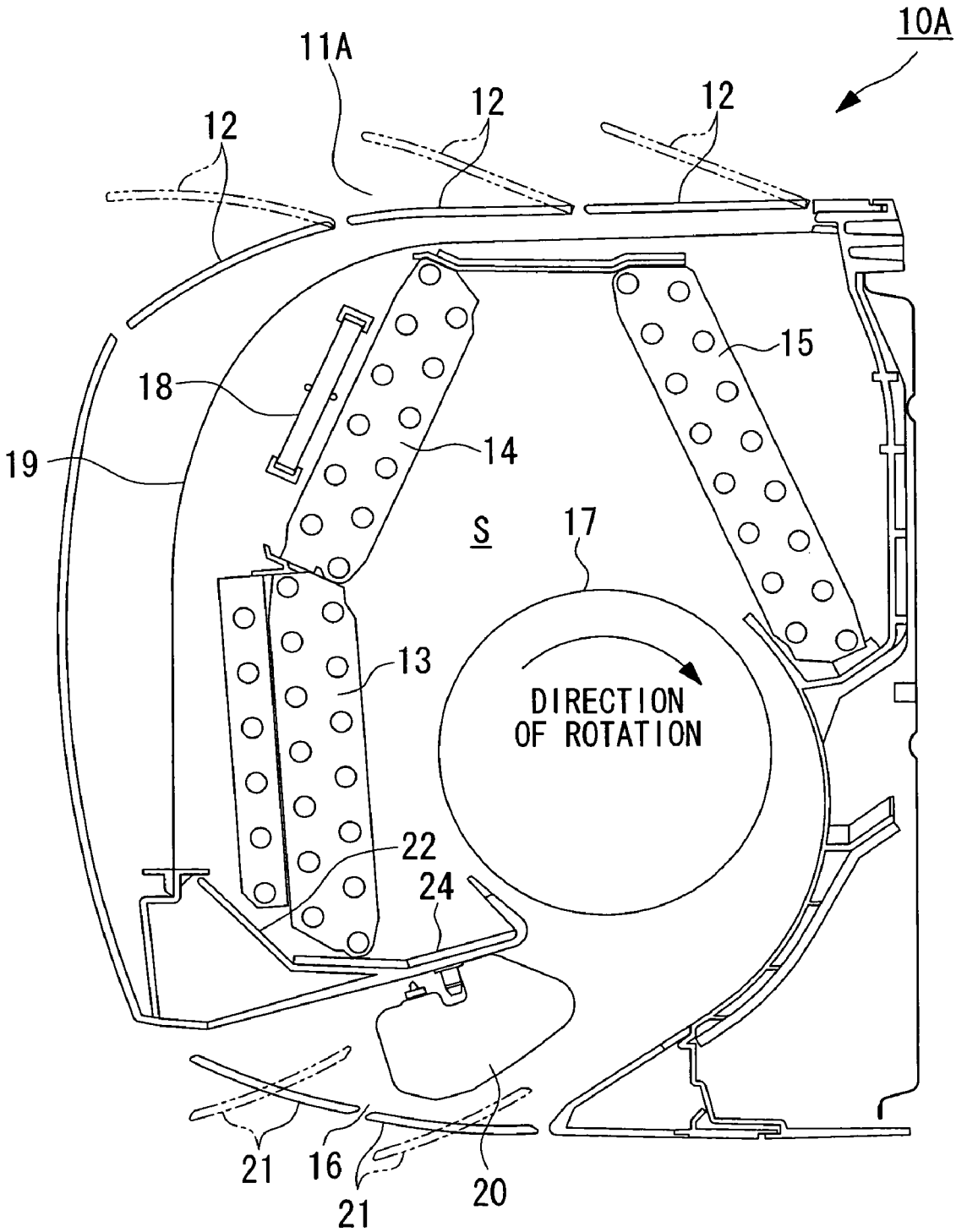
FIG. 12 is a sectional view of a modified example of the indoor air-conditioning unit shown in FIG. 1.

Therefore, as a modified example of the aforementioned embodiment, an indoor air-conditioning unit 10A constructed to implement a heating operation with the internal space S totally enclosed will be described with reference to FIG. 12. In this modified example, there is provided, for example at the intake grill 11A, an inlet open/close device (internal air retaining device) such as inlet flaps 12, so that the intake grill 11A can be closed according to requirements such as during the heating operation. Therefore, for example during the heating operation, this gives a totally enclosed internal space S which is closed by the flaps of both the intake grill 11A and the diffuser 16, so that it is difficult for the high temperature and humidity atmosphere for allergen deactivation to leak out to the outside.

When the heating operation is implemented in such a totally enclosed condition, since there is no leakage of the atmosphere to the outside, the temperature and the humidity of the internal space S interior can be readily maintained, and hence the efficiency of activating the enzymes 18*c* is improved. That is to say, the target allergen deactivation atmosphere is formed in a shorter time than when the heating operation is performed in the semi-enclosed condition. Furthermore, the amount of heat energy consumed in order to maintain the high temperature and high humidity atmosphere, and the amount of condensed water can be reduced.

Moreover, at the time of the heating operation with the internal space S enclosed in this manner, it is desirable to agitate the air by rotating the cross-flow fan 17. By performing such agitation, the high temperature and high humidity atmosphere in the enclosed internal space S interior becomes substantially uniform.

Therefore, in the allergen deactivation filter 18, the enzymes 18*c* are activated over the entire area. That is to say, the enzymes 18*c* function over the entire area of the allergen deactivation filter 18 so that the allergens can be effectively deactivated. Hence the performance as a filter can be effectively used to the maximum limit.

Figure 13:
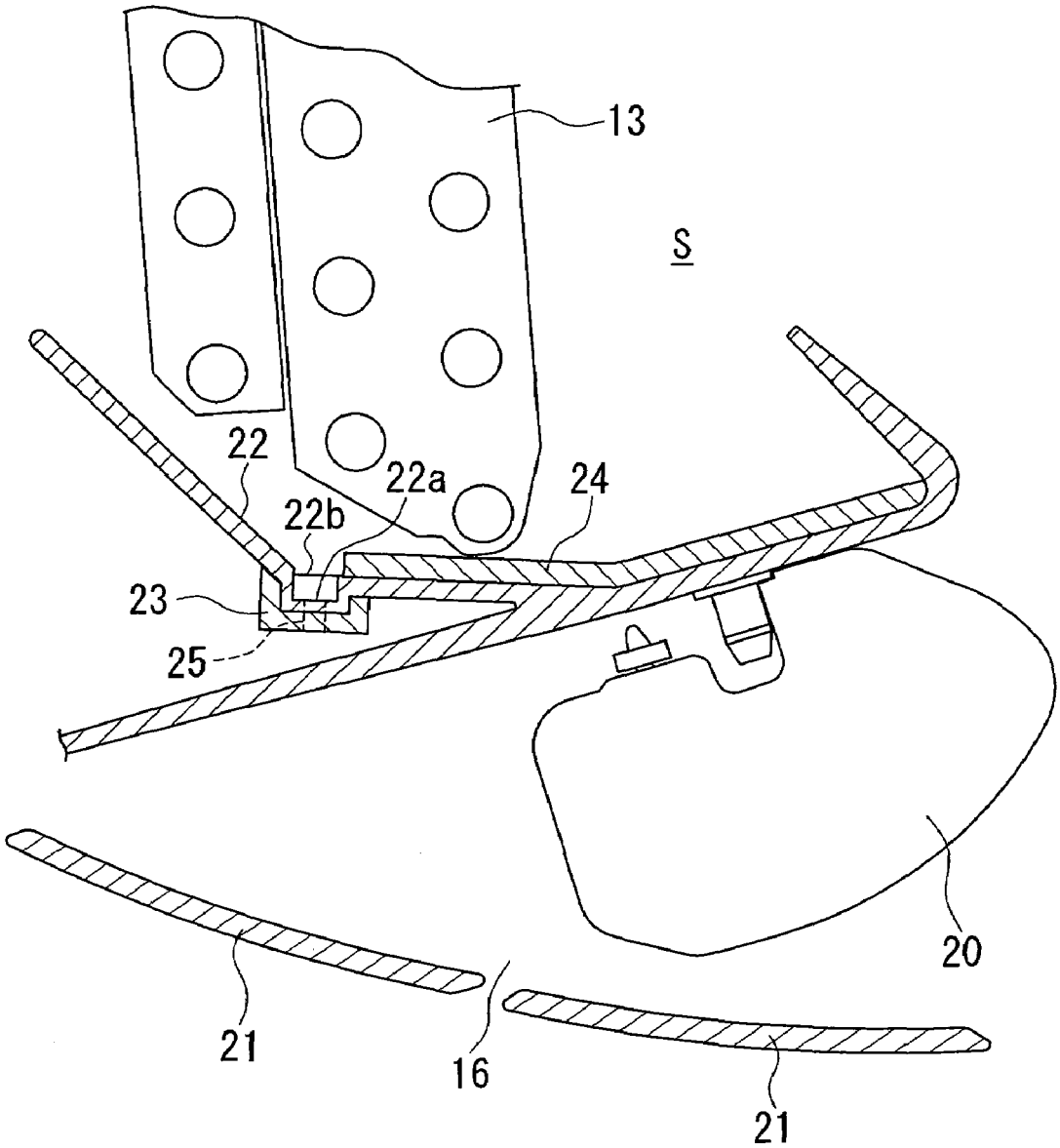
FIG. 13 is a sectional view of main parts illustrating a second embodiment an indoor air-conditioning unit according to the present invention.
Figure 14:
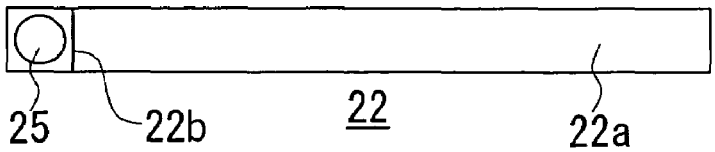
FIG. 14 is a plan view showing a trough of FIG. 13.

Next, a second embodiment of the enzyme activation device will be described with reference to FIG. 13 and FIG. 14.

The enzyme activation device of this embodiment is one which heats and evaporates the condensed water generated by the cooling operation of the indoor heat exchangers 13, 14 and 15, and stored in the drain pan 22, by means of a heating device such as an electric heater 23 provided at a suitable place near the drain pan 22, to form a warm humid atmosphere. Reference symbol 24 in the figure denotes insulating material, and 25 denotes a drain hole provided in the bottom of the drain pan 22.

That is to say, there is provided a trough 22*a* for collecting condensed water formed by executing the normal cooler and dehumidifying operation, and the abovementioned condensed water generating operation of the first embodiment, and which drips from the surfaces of the heat exchangers into the drain pan 22. The trough 22*a* is preferably of a gutter shape formed at the bottom of the drain pan 22 and extends in the transverse direction of the indoor air-conditioning unit 10, so that the water vapor rising approximately straight up will impinge evenly over the entire area of the allergen deactivation filter 18. Moreover, the condensed water storage capacity of the trough 22*a* should be such as to able to ensure an amount of water to at least maintain the desired high temperature and humidity in the internal space S over the heating operation time Thm described in the first embodiment. This condensed water storage capacity is prescribed for example by the cross-section and length of the trough 22*a*, and also by the height of a weir 22*b* provided in the vicinity of the drain hole 25.

The trough 22*a* is not limited to the gutter shape extending in the transverse direction, and various modified examples are possible such as one which is divided into sections at regular intervals across the width.

According to such a construction, as with the heating operation of the abovementioned first embodiment, the internal space S is semi-enclosed or fully enclosed and the electric heater 23 then switched on and heated. At this time, regarding the cross-flow fan 17, preferably when the internal space, S is semi-enclosed, operation is stopped, while when fully enclosed this executes an agitating operation. In this case the enzyme activation device can be formed by adding the electric heater 23 of the heating device to the ordinary indoor air-conditioning unit, and adding a slight modification to the shape of the drain pan 22.

Furthermore, regarding the switching on of the electric heater, it is desirable to have suitable adjustment such as on/off switching so that the necessary heating operation time can be ensured, as with the on/off operation of the compressor 31 and the outdoor fan 33 shown in FIG. 11.

As a result, the internal space S interior is maintained at the enzyme activation atmosphere of high temperature and humidity, so that the enzymes 18*c* are activated and actively breakdown the allergens, and hence the allergens can be deactivated.

Moreover, the various operations such as the collection operation and the ventilation operation performed before and after the heating operation may be performed in the same manner as in the abovementioned first embodiment.

As described above, according to the indoor air-conditioning unit of the present invention and the air-conditioning apparatus incorporating this, there is provided the enzyme deactivation device which gives an environment for deactivation of the enzymes 18*c* supported on the allergen deactivation filter 18. Therefore, the allergens are aggressively broken down and deactivated so that an indoor environment with reduced indoor allergen concentration and thus less likelihood of producing allergic symptom can be provided.

The construction of the present invention is not limited to the above mentioned embodiments, and can be appropriately modified within a scope which does not deviate from the gist of the present invention.

For example, instead of the indoor air-conditioning unit 10, the present invention may be applied to a HVAC (Heating, Ventilation and Air Conditioning) unit used in a vehicle air conditioner. In this case, as the internal air retaining device, an airflow path switching damper which can partition a space by switching thereof may be used.

What is claimed is:

1. A method for controlling an air-conditioning unit comprising:

drawing air in from an inlet;

exchanging heat between air drawn in from said inlet and a refrigerant using a heat exchanger;

discharging air that has been heat-exchanged using said heat exchanger from a diffuser using an airflow device; and activating an allergen deactivation enzyme supported by an enzyme carrier in an internal space of the air-conditioning unit by creating an atmosphere in the internal space that is operable to activate the enzyme, retaining air flow within the internal space using an internal air retaining device;

wherein the internal air retaining device is an open/close device operable to close part of or all of openings communicating with the internal space to keep the internal space in a semi-enclosed or fully enclosed condition; and wherein said retaining comprises having the internal space enclosed in the semi-enclosed or fully enclosed condition during said activating and operating said airflow device to agitate the air of the atmosphere in the internal space that is operable to activate the enzyme.

2. The method of claim 1, wherein said activating comprises heating and evaporating condensed water, generated by a cooling operation of the heat exchanger, using a heating operation of the heat exchanger performed after the cooling operation.

3. The method of claim 1, wherein said activating comprises heating and evaporating condensed water, generated by a cooling operation of the heat exchanger and stored on a drain pan, using a heating device.

4. The method of claim 2, further comprising, after said activating, removing moisture from the enzyme carrier in order to prevent degradation thereof.

5. The method of claim 1, further comprising, before said activating, collecting allergens by drawing air in to the internal space and passing the air through the enzyme carrier.

* * * * *